US005394777A

United States Patent [19]

Kozikowski

[11] Patent Number: 5,394,777

[45] Date of Patent: Mar. 7, 1995

[54] THERMALLY ENHANCED SHAVING SYSTEM

[75] Inventor: Stanislaw D. Kozikowski, Milford, Conn.

[73] Assignee: Warner-Lambert Company, Morris Plains, N.J.

[21] Appl. No.: 766,612

[22] Filed: Sep. 26, 1991

[51] Int. Cl.[6] ..... B26B 21/48

[52] U.S. Cl. ..... 83/15; 83/22; 30/34.05; 30/140

[58] Field of Search ..... 83/13, 14, 15, 22; 30/34.05, 140, 90

[56] References Cited

U.S. PATENT DOCUMENTS

| | | | |
|---|---|---|---|
| 2,318,255 | 5/1943 | Nichols | 30/34.05 |
| 2,912,753 | 11/1959 | Henry | 30/34.2 |
| 3,364,568 | 1/1968 | Lowy | 30/34.05 |
| 4,443,940 | 4/1984 | Francis et al. | 30/50 |
| 4,850,107 | 7/1989 | Valliades et al. | 30/86 X |
| 5,065,515 | 11/1991 | Iderosa | 83/16 X |

*Primary Examiner*—Eugenia Jones
*Attorney, Agent, or Firm*—Charles W. Almer, III

[57] ABSTRACT

A thermally enhanced shaving device is provided including a hot air supply, a blade, a housing on which the blade is mounted, and an elongated handle to which the housing is attached. The housing has a continuous hot air passageway through it which has an exit and an entrance. The blade is mounted across the exit of the passageway, while the handle has an internal channel which is connected to the entrance of the hot air passageway. The hot air supply includes a heating filament and fan which can be positioned either within the channel or remote thereto. In any case, the hot air supply, the channel, and the air passageway are all in fluid communication with one another. The device is operated by blowing ambient air across the hot filament using the fan such that the channel directs the resulting hot air through the passageway, past the blade, and onto the surface to be shaven immediately ahead of the blade's shaving path.

22 Claims, 2 Drawing Sheets

THERMALLY ENHANCED SHAVING SYSTEM

FIELD OF THE INVENTION

This invention pertains generally to shaving devices. More particularly, the present invention pertains to shaving devices which heat hair before the hair is shaved. The present invention is particularly, but not exclusively, useful for a dry shaving operation wherein hot air is directed onto a skin surface to heat hair immediately prior to the hair being shaved.

BACKGROUND OF THE INVENTION

For almost every shaving operation it is known that hair is more easily cut when it is heated. Additionally, it is known that heating the skin surface which is being shaved also helps soothe and comfort the skin. These advantages which are realized when heat is applied to the hair and surface to be shaved are important to any shaving process.

In a typical blade shaving process, the cutting edge the a blade is drawn across the skin surface to cut hair that is in the path of the blade. When a safety razor is used, this process normally involves first wetting the surface to be shaved with warm water. A hair softening agent, such as shaving cream or lotion, may also be applied on the surface. Such a procedure is called a "wet" shave and is to be distinguished from a "dry" shave where no water is used, and no hair softening agents are applied. Despite several apparent conveniences a "dry" shave can have some disadvantages. The main drawback to "dry" shaving is that razor blades cannot be used repeatedly, or for extended "dry" shaving operations, due to the rapid deterioration of their cutting edges when the blades are used without any hair softening agents. Furthermore, as the cutting edge deteriorates, the blade becomes more and more useless and the possibility of extreme irritation to the skin is increased. The present invention, however, recognizes that many of the problems normally associated with "dry" shaving can be avoided if the hair and skin surface to be shaved are properly heated.

Through the years many shaving systems and procedures have been proposed for the purpose of providing greater shaving comfort. For instance, the application of hot water or hot shaving cream to a skin surface prior to shaving is known to provide greater comfort during the shaving operation. Unfortunately, hot water is not always readily available. Even when hot water is available, it will rapidly cool down after it is applied to the skin. Furthermore, if shaving cream is used, it may be cold and, aside from its lubricating effect this will tend to reduce the advantage gained from the hot water. On the other hand, hot shaving cream may be impractical. There must be some means for heating the shaving cream and, even if a hot shaving cream dispenser is available, it is often inconvenient to heat the shaving cream prior to shaving. In any case, shaving cream is disfavored by many because it can cover an area from view, such as the edge of a beard, which could then be mistakenly shaven. As recognized by the present invention, many of these disadvantages encountered in a "wet" shaving system can be overcome if a "dry" shaving system is used.

As implied above, to be comfortable, a "dry" shaving system must efficiently employ the use of heat. Shavers with heated blades that conduct heat directly from the blade to the hair prior to shaving have been proposed for a "dry" shaving operation. Heated blades, however, are problematic because of the potential for skin burns which can be caused when the heated blade contacts the skin. Additionally, heated blades are relatively inefficient because the blade does not efficiently conduct heat to the hair. This problem is due to insufficient heat transfer and is caused by several factors. These factors include the area of contact between the blade and the hair, the temperature difference between the blade and the hair, and the amount of time the blade contacts the hair. When using only a heated blade the area of contact between the cutting edge of the blade and the hair shaft is extremely limited due to the fineness of both the hair and the edge of the blade. To overcome this disadvantage, the blade temperature should be raised. There is a limit, however, since the blade temperature must be maintained below the temperature at which skin will blister or burn. Time is thus the only remaining process variable. It happens, however, that the time which is required to effectively heat hair with only a heated blade renders their use effectively impractical. The present invention recognizes that other ways for heating the hair and skin surface need to be provided.

In light of the above, it is an object of the present invention to provide a shaving system which is able to achieve a comfortable "dry" shave without requiring the application of a heated substance such as hot water or heated shaving cream to the area to be shaved. It is another object of the present invention to heat hair and shave the heated hair before it cools. It is yet another object of the present invention to provide a thermally enhanced shaver which will heat an area of skin without causing burns. It is still another object of the present invention to provide a thermally enhanced shaver which uses hot air to heat the blades in addition to the area to be shaved. Yet another object of the present invention is to provide a thermally enhanced shaver which is relatively easy to manufacture and which is comparatively cost effective.

SUMMARY OF THE INVENTION

The present invention is a thermally enhanced shaving device comprising a heat source, a razor blade, a blade housing on which the blade is mounted, and an elongated handle to which the housing is attachable. The housing is formed with a continuous hot air passageway which has an exit and an entrance. The blade is mounted across the exit of the hot air passageway. The handle has an internal channel with an air intake and an air outlet. The outlet is connected to the entrance of the hot air passageway when the housing is attached to the handle.

The heat source is a heater unit comprising an electrically resistive filament upstream of an electrically powered fan. The heater unit can either be positioned within the channel or be located remotely therefrom. In either position the heater unit is maintained in fluid communication with the channel, which in turn is in fluid communication with the air passageway. Accordingly, the present device operates by activating the heater unit to blow ambient air across the hot filament. The channel then directs the heated air into the air passageway, where it flows past the blade and onto the surface to be shaven which is immediately ahead of the blade's shaving path.

For one embodiment of the present invention, positioning of the heater unit within the channel is accomplished simply by mounting the fan and filament directly in the handle. For another embodiment of the present invention the heater unit may be distanced from the shaver. This is accomplished by connecting one end of a tube to the air intake in the handle and the other end of the tube to the remote heater unit. A passageway for fluid communication between the heater unit and channel is thereby provided. In either of these embodiments of the invention, the shaving device can have two or more blades mounted on the housing, rather than the single blade as described above.

In operation the thermally enhanced shaving device effectively heats hair to be shaven with hot air immediately ahead of the cutting blade. The hair is then shaved before it substantially cools. For this operation, the hair is heated to a temperature in the range of approximately 140°–150° F. Importantly, the present device effectively operates without any pretreatment of the skin surface to be shaved with hot water or heated hair softening agents. Thus, the enhanced shaving device of the present invention provides an effective combination for dry shaving.

The novel features of this invention, as well as the invention itself, will be best understood from the accompanying drawings taken together with the accompanying description in which similar reference characters refer to similar parts and in which:

BRIEF DESCRIPTION OF THE DRAWINGS

FIG. 3A is a cross-sectional view of an embodiment of the housing as seen along line 3A—3A in FIG. 2.

FIG. 3B is a cross-sectional view of an alternate embodiment of the housing.

FIG. 4 is a cross-sectional view of the shaver as seen along line 4—4 in FIG. 1.

FIG. 5 is a schematic view of an alternate embodiment of the shaver.

DESCRIPTION OF THE PREFERRED EMBODIMENT

Figure 1:
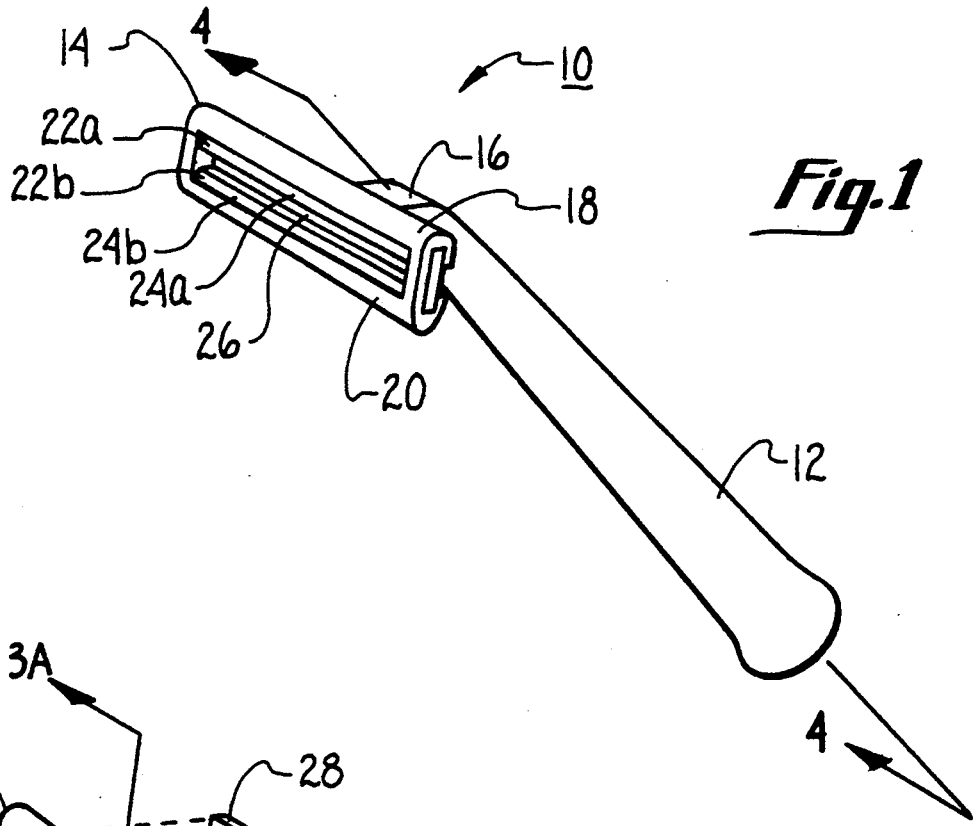
FIG. 1 is a perspective view of the shaver.

Referring to FIG. 1, a thermally enhanced shaver is shown and generally designated 10. Shaver 10 comprises a handle 12 and a blade housing 14 removably attached to end 16 of handle 12. Housing 14 comprises upper guard bar 18 and lower guard bar 20 which are aligned in parallel to each other. One or more blades are mounted in parallel on housing 14 between guard bars 18 and 20. The embodiment of FIG. 1 shows two blades **22*a* and 22*b* so mounted, which are aligned in parallel with one another and with guard bars 18 and 20. Each blade 22*a*, 22*b* has a cutting edge 24*a*, 24*b* exposed between guard bars 18 and 20 for shaving hair. Positioned between blades 22*a*, 22*b* is an air passageway 26** further described below.

Figure 2:
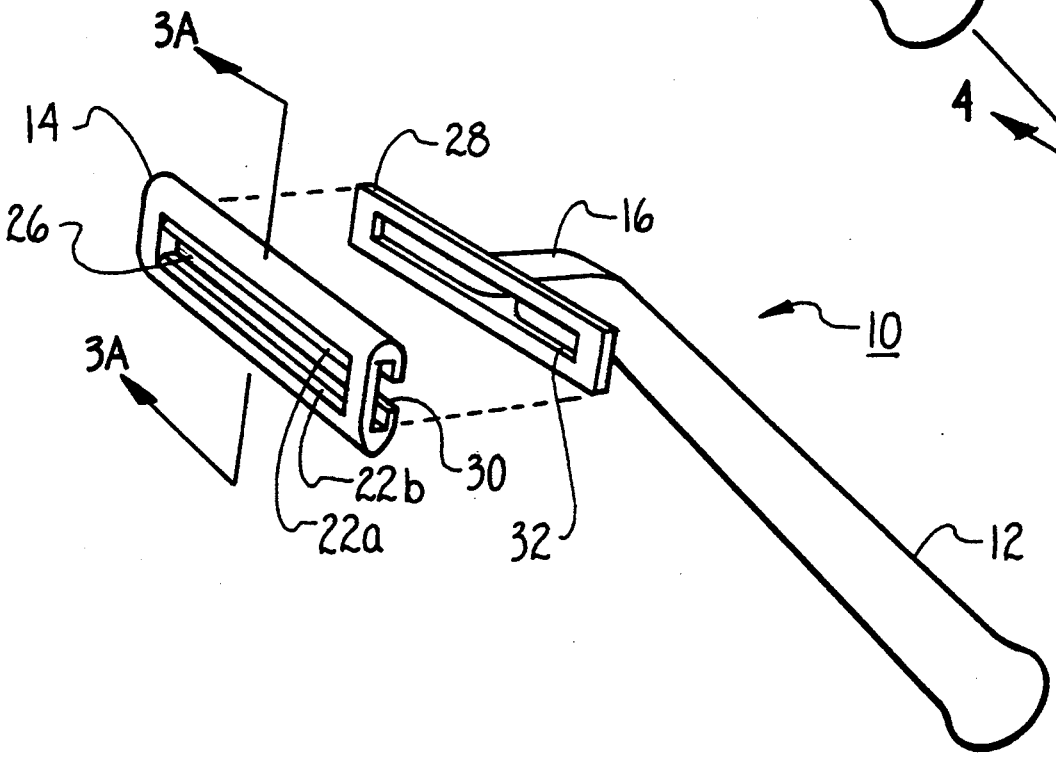
FIG. 2 is an exploded view of the shaver in FIG. 1.

FIG. 2 shows an exploded view of shaver 10, in which blade housing 14 is detached from handle 12. Handle end 16 is formed with a rail 28 which slidably fits within a track 30 in housing 14 for attachment of housing 14 to handle 12. Accordingly, it can be appreciated that housing 14 may be easily replaced as desired, such as when blades **22*a*, 22*b* become dull. A hollow channel 32 is provided at end 16 which extends internally within handle 12 and aligns in fluid communication with air passageway 26 when track 30 is properly fitted over rail 28**.

FIG. 3A shows a cross-section of blade housing 14 in detail. Air passageway 26 is formed within housing 14 and has an entrance 34 and exit 36 at opposite ends thereof. Blades **22*a*, 22*b* are mounted on housing 14 across exit 36 such that hot air passing through air passageway 26 passes across blades 22*a*, 22*b*. Additionally, blades 22*a*, 22*b* are positioned to direct the hot air onto an area to be shaven in front of the blades. Blades 22*a*, 22*b* may be any type known in the art and can be mounted on housing 14 with their cutting edges 24*a*, 24*b* approximately perpendicular to the direction of hot air flow through air passageway 26. It can be appreciated by viewing FIG. 2 in conjunction with FIG. 3A that entrance 34 is positioned in alignment with channel 32 when housing 14 is mounted on handle 12. In this position, fluid communication is established between air passageway 26 and channel 32**.

As mounted on housing 14, blades **22*a*, 22*b* partition exit 36 into openings 36*a*, 36*b* beneath blades 22*a*, 22*b*, respectively. Specifically, opening 36a is formed between blades 22*a* and 22*b* and opening 36*b* is formed between lower guard bar 20 and blade 22*b*. FIG. 3B shows an alternate embodiment of housing 12 wherein exit 38 comprises a single opening 38*a* formed between lower guard bar 20 and blade 22*b***.

Referring now to FIG. 4, it can be seen that channel 32 extends internally through handle 12 between air outlet 40 at handle end 16 and air intake 42 at opposite handle end 44, which renders handle 12 substantially tubular. Thus, when device 10 is assembled as shown, a continuous air flow path 46 is provided from the ambient atmosphere 48 through air intake 42, channel 32, outlet 40, entrance 34, air passageway 26, and exit 36 onto a surface 50 to be shaven. Handle 12 and housing 14 are made of any suitable heat resistant material within the purview of the skilled artisan.

As further shown in FIG. 4, an electric powered fan 52 and a resistive filament 54 are mounted within channel 32. Fan 52 is positioned between intake 42 and filament 54 to direct ambient air into channel 32 and past filament 54. Both filament 54 and fan 52 are electrically connected by conductive wire assembly 56 to a conventional power source, such as a disposable battery 58 affixed to handle 12.

Referring to FIG. 5, in an alternate embodiment, shaver **10*a* has a remote heater unit 60 in fluid communication with a shortened channel in handle 12*a* and an air passageway in blade housing 14*a* via a flexible tube 62. Heater unit 60 employs a fan and filament similar to those shown in FIG. 4. It can be appreciated, however, that by positioning heater unit 60 remote from handle 12*a*, larger scale components can be used in unit 60 to increase the effectiveness of device 10. Furthermore, unit 60 can be readily powered with ac current obtained from a conventional household wall outlet. Tube 62 connects with the internal channel of handle 12*a* across an intake orifice 64 formed in handle 12*a*. As such, it is apparent that unit 60 can even be a conventional hair dryer which is adapted to blow hot air through tube 62** into the channel.

OPERATION

Operation of device 10 is described below with reference to FIG. 4. Device 10 is initiated by powering fan 52 and filament 54 with battery 58. Ambient air from surrounding environment 48 is drawn into inlet opening 42 of channel 32 by means of fan 52 rotating therein. Channel 32 directs the ambient air driven by fan 52 over filament 54 which is maintained at a high temperature. Filament 54 heats the ambient air to an elevated temperature, preferably between about 140° and 150° F. Filament 54 may be provided with a conventional adjustment means, allowing a user to regulate the temperature of filament 54 and correspondingly the temperature of the hot air. The rotational speed of fan 52 may also be adjustable to maintain a desired rate of air flow through channel 32. Thus, hot air temperature and air flow rate may be regulated to maintain comfort and to avoid skin burns.

Upon heating the air, fan 52 drives the hot air out of channel 32 and into air passageway 26. Preferably, heating filament 54 is mounted relatively close to air passageway 26 to minimize heat losses in channel 32. Air passageway 26 distributes the hot air across exit 38 and onto the surface to be shaven 50. In so doing, the hot air uniformly heats the hair at the area to be shaven 50 along with blades 22*a*, 22*b* and guard bars 18 and 20, thereby achieving a thermally stable system.

Although operation of device 10 has been described above with reference to FIG. 4, it is understood that device 10*a* shown in the embodiment of FIG. 5 operates in a substantially similar manner.

While the particular shaving device as herein shown and disclosed in detail is fully capable of obtaining the objects and providing the advantages herein stated, it is to be understood that it is merely illustrative of the presently preferred embodiments of the invention and that no limitations are intended to the details of construction or design herein shown other than as defined in the appended claims. In particular, it can be appreciated that any means known in the art other than that disclosed herein may be used to heat and direct the heated air through the blade housing onto the shaving surface and falls within the scope of the present invention.

I claim:

1. A method for shaving hair from a body surface comprising the steps of:

providing a thermally assisted shaving device having a heat source, a blade, a blade housing on which said blade is mounted, and a handle to which said housing is attached, wherein said housing is formed with a hot air passageway therethrough having an exit and an entrance and said blade is mounted in said exit, further wherein said handle has a channel internal thereto connected to said entrance, and said heat source includes a heating filament and a fan in fluid communication with said channel;

heating said filament to an elevated temperature exceeding ambient temperature;

blowing ambient air across said hot filament with said fan to heat said ambient air to hot air;

positioning said device such that said housing abuts said body surface, wherein said exit and blade are juxtaposed with said body surface;

directing said hot air through said channel, into said air passageway, past said blade, out said exit, and onto said body surface ahead of a shaving path for said blade;

heating said hair on said body surface with said hot air; and shaving said heated hair from said body surface with said blade by sliding said blade housing across said body surface, wherein said blade follows said shaving path.

2. A method for shaving hair from a body surface as recited in claim 1 wherein said ambient air is heated to a temperature between about 140° and 150° F.

3. A method for shaving hair from a body surface as recited in claim 1 further comprising the step of drying said body surface before shaving hair from said body surface.

4. A method for shaving hair from a body surface as recited in claim 1 further comprising the step of applying a hair softening agent to said body surface before shaving hair from said body surface.

5. A thermally assisted device for shaving hair on a body surface which comprises:

a blade housing formed with a hot air passageway;

a blade mounted on said housing and positioned in said air passageway to permit hot air flow past said blade;

a means for heating ambient air to hot air; and a means for driving said hot air through said passageway to heat said hair on said body surface.

6. A device as recited in claim 5 further comprising an elongated handle having an end attachable to said housing, wherein said handle is formed with an internal channel in fluid communication with said air passageway.

7. A device as recited in claim 6 wherein said housing has a pair of substantially parallely aligned guard bars, said air passageway having an exit positioned between said guard bars and juxtaposable with said body surface.

8. A device as recited in claim 7 wherein said blade is mounted in said exit and is substantially parallely aligned with said guard bars.

9. A device as recited in claim 7 further comprising a plurality of blades mounted in said exit and aligned substantially parallel to said guard bars.

10. A device as recited in claim 9 wherein said plurality of blades partition said exit into a plurality of openings.

11. A device as recited in claim 6 wherein said air heating means and said air driving means are mounted within said channel.

12. A device as recited in claim 6 wherein said air heating means and said air driving means are located at a remote position from said handle and in fluid communication with said handle.

13. A device as recited in claim 12 further comprising a tube extending between said handle and said air heating means to provide fluid communication therebetween.

14. A device as recited in claim 5 further comprising a plurality of blades aligned substantially parallel to each other and mounted within said air passageway.

15. A device as recited in claim 5 wherein said air heating means is an electric heating filament.

16. A device as recited in claim 5 wherein said air driving means is a fan.

17. A shaving device for cutting hair comprising:

a handle;

a blade housing attached to said handle, said housing formed with a hot air passageway therethrough;

a blade mounted on said housing in said hot air passageway for cutting said hair;

means for heating ambient air to hot air; and means for directing said hot air into said air passageway.

18. A device as recited in claim 17 wherein said directing means includes a channel formed in said handle in fluid communication with said hot air passageway.

19. A device as recited in claim 18 wherein said air heating means is mounted in said channel.

20. A device as recited in claim 18 wherein said directing means further includes a tube connected at a first end to said channel and connected at a second end to said air heating means remotely positioned from said channel, said tube providing fluid communication between said channel and said heating means.

21. A device as recited in claim 17 wherein said blade housing is slidably removable from said handle.

22. A device as recited in claim 17 wherein said directing means includes an entrance to said hot air passageway.

* * * * *